US006398210B1

(12) United States Patent
Nomura

(10) Patent No.: US 6,398,210 B1
(45) Date of Patent: Jun. 4, 2002

(54) SHEET CARTRIDGE AND SHEET FEEDING APPARATUS

(75) Inventor: Susumu Nomura, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/717,232

(22) Filed: Nov. 22, 2000

(51) Int. Cl.[7] ..... B65H 1/00
(52) U.S. Cl. ..... 271/145; 271/147; 271/162
(58) Field of Search ..... 271/145, 147, 271/160, 162, 164, 126, 30.1, 128; 221/187, 287

(56) References Cited

U.S. PATENT DOCUMENTS 4,219,192 A * 8/1980 Burke ..... 271/160
4,504,053 A * 3/1985 Shiozawa ..... 271/157 X
4,535,982 A * 8/1985 Mochimaru ..... 271/127
4,765,605 A * 8/1988 Abbott ..... 271/164
4,830,354 A * 5/1989 Penson ..... 271/147

FOREIGN PATENT DOCUMENTS

JP 8-262825 10/1996

* cited by examiner

*Primary Examiner*—David H. Bollinger
(74) *Attorney, Agent, or Firm*—Foley & Lardner

(57) ABSTRACT

A sheet feeding apparatus of the present invention is provided with a casing having an open top, a lid member for closing the open top of the casing, a cartridge being insertable into the casing from above and storing sheets inside, an raising arm located in the inner bottom region of the casing, for raising the sheets in the cassette, and a pickup roller and a separation roller, which are located on an inner surface of the lid member, for taking out the raised sheets while being in contact therewith. The cartridge includes a container having a holding member located in the bottom thereof and adapted to hold a maximum replenishment number of sheets in a stacked state, and an insertion hole which is formed in the bottom of the container and into which the raising means is inserted to raise the holding member.

11 Claims, 6 Drawing Sheets

SHEET CARTRIDGE AND SHEET FEEDING APPARATUS

BACKGROUND OF THE INVENTION

The present invention relates to a sheet cartridge for storing sheets, such as copying sheets of paper. The present invention also relates to a sheet feeding apparatus for feeding sheets from the sheet cassette to the image transfer section of a copying machine, for example.

In some types of copying machine, a sheet feeder of a large storage capacity is provided, and a large number of sheets are successively supplied from the feeder to an image transfer section.

The sheet feeder has a storage section capable of storing a large number of sheets (e.g., 2,000 sheets). Arranged inside the storage section are a tray that holds sheets stacked thereon, and a vertically-moving mechanism for vertically moving the tray. A pickup roller for picking up sheets, a separation roller for separating the picked-up sheets, etc. are located in the upper region of the storage section.

According to the prior art, however, the operation of replenishing the sheet feeder with a large number of sheets has to be performed in units of a predetermined number (e.g., 500 sheets), and this replenishing operation has to be repeated a number of times, which is troublesome.

The sheets of the predetermined number are packaged with wrapping paper, and the this wrapping paper has to be removed, which is also troublesome.

Since the removed wrapping paper is rubbish, it makes the post-cleaning operation inefficient and uneconomical.

At the time of replenishment, the sheets are horizontally inserted into the storage section of the sheet feeder. If the sheet feeder is located very close to a wall of a building, the replenishment operation may be impossible. Since, therefore, the sheet feeder has to be away from the wall, the sheet feeder inevitably requires a large installation space.

Since the sheets are stored in the state where they are wrapped with wrapping paper, the moisture tends to deprive the sheets of resiliency, which may lead to adverse effects on the sheet-feeding performance. In addition, the wrapping paper does not protect the sheets from external shock, and damage may be given to the sheets.

BRIEF SUMMARY OF THE INVENTION

The present invention has been conceived in consideration of the above circumstances, and the object of the present invention is to provide a sheet cartridge and a sheet feeding apparatus which enable the supply of a large number of sheets by executing a replenishing operation only once, which do not require a large installation space, and which help to maintain the quality of the sheets and protect them from damage even if external shock is applied.

One sheet cartridge according to the present invention comprises a container having a holding member located in the bottom and adapted to hold a maximum replenishment number of sheets in a stacked state. An insertion hole is formed in the bottom of the container, and a member for raising the holding member is inserted into the insertion hole.

Another sheet cartridge according to the present invention comprises: a container formed of synthetic resin and having an open top and a holding member, the holding member being located in the bottom of the container and adapted to hold a maximum replenishment number of sheets in a stacked state; an opening/closing member for opening or closing the top of the container; packing interposed between the opening/closing member and the edges of the open top of the container; an insertion hole which is formed in the bottom of the container and into which a member for raising the holding member is inserted; and a cover member which is removable and with which the insertion hole is covered.

A sheet feeding apparatus according to the present invention comprises: a main body which has an open top; a closing/opening member for closing or opening the main body; a cartridge being insertable into the main body from above and storing sheets inside; raising means, located at the bottom of the main body, for raising the sheets inside the cartridge; and takeout/supply means, located on an inner surface of the closing/opening member, for taking out the raised sheets while being in contact therewith, the cartridge including: a container having a holding member, the holding member being located in the bottom of the container and adapted to hold a maximum replenishment number of sheets in a stacked state; and an insertion hole which is formed in the bottom of the container and into which the raising means is inserted to raise the holding member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will now be described, referring to the embodiments shown in the accompanying drawings.

Figure 1:
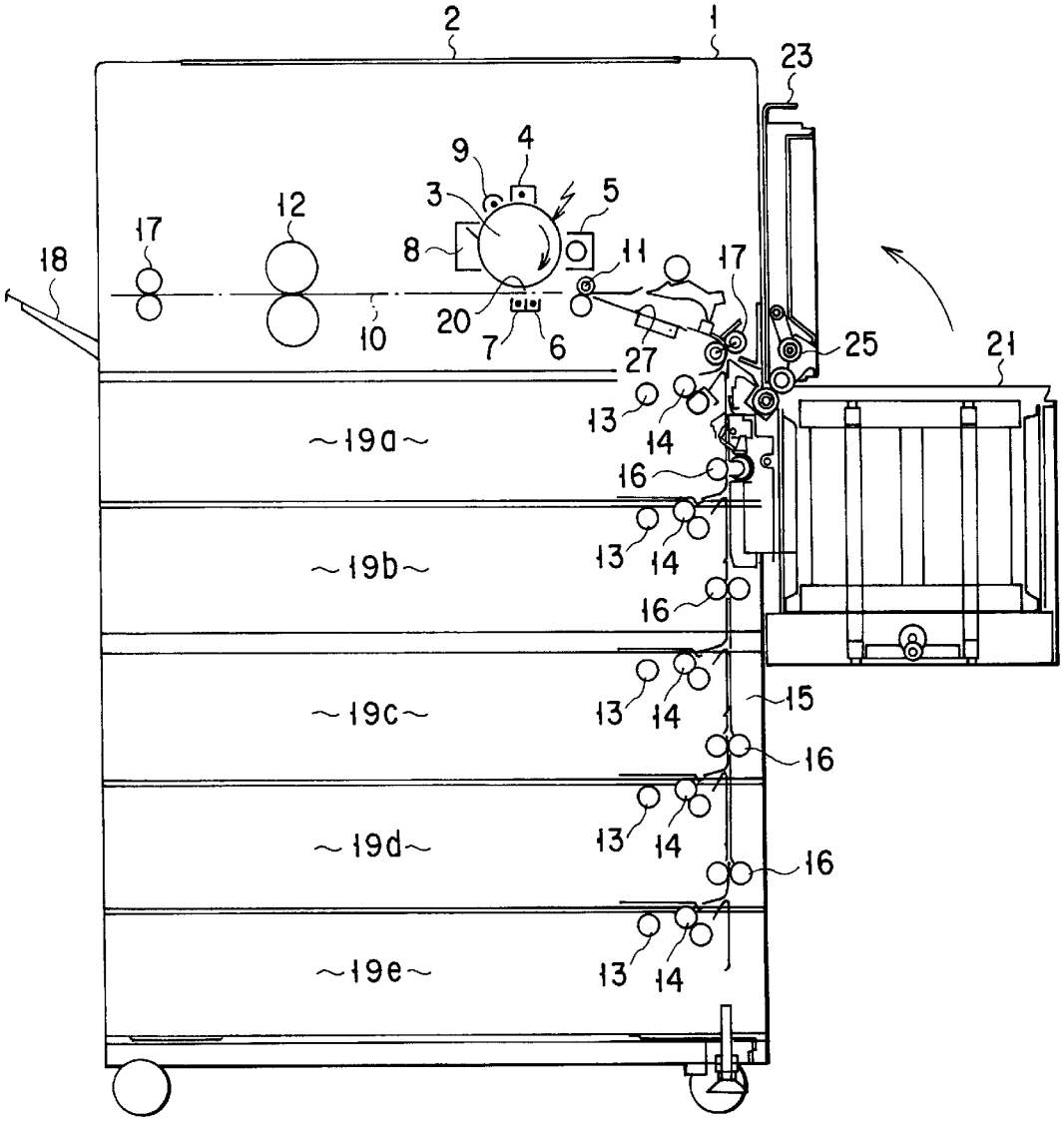
FIG. 1 is a structural illustration showing a copying machine according to one embodiment of the present invention.

FIG. 1 shows the internal structure of a copying machine according to one embodiment of the present invention.

In FIG. 1, reference numeral 1 denotes a main body, and a document table 2 for holding a document mounted thereon is provided on top of the main body. An exposure mechanism (not shown) is arranged under the document table 2. The exposure mechanism radiates light to the document and forms an electrostatic latent image corresponding to a document image on a photosensitive drum 3, which will be described later.

The photosensitive drum 3 is located in the center of the upper region of the main body 1. The photosensitive drum 3 is rotatable in the direction indicated by the arrow. Arranged around the photosensitive drum 3 are a charger 4, a developer 5, transfer and separation chargers 6 and 7, a cleaning unit 8 and an electrical discharger 9. These structural components are arranged in the rotating direction of the photosensitive drum 3 in the order mentioned.

The charger 4 uniformly charges the surface of the photosensitive drum 3. The developer 5 supplies a developing agent to the electrostatic latent image formed on the developing drum 3. The transfer charger 6 serves to transfer a developer image formed on the photosensitive drum 3 to a sheet, such as a sheet of paper. The separation charger 7 serves to separate the sheet from the photosensitive drum 3 after the developer image has been transferred to the sheet. The cleaning unit 8 removes a residual developing agent from the photosensitive drum 3 after the transfer of the developer image. The electrical discharger 9 serves to remove the residual potential from the photosensitive charger 3.

Inside the main body 1, a horizontal conveyance path 10 is provided such that it extends in the region under the photosensitive drum 3. Register rollers 11, the transfer and separation chargers 6 and 7, a fixing unit 12 and discharging rollers 17 are arranged in order along the conveyance path 10. A sheet discharge tray 18, which receives sheets discharged from the discharging rollers 17, is arranged on one side of the main body 1.

A plurality of sheet feed cassettes 19*a*–19*e*, which are for storing sheets of respective sizes, are located under the main body 1. The sheets of each of the sheet feed cassettes 19*a* to 19*e* are taken out by pickup rollers 13, and are then separated from one another and fed one by one.

A vertical conveyance path 15 extends in the sheet feed direction of the sheet feed cassettes 19*a* to 19*e*. A number of pairs of conveyance rollers 16 . . . are arranged along the vertical conveyance path 15 in such a manner that each pair of conveyance rollers is spaced from another by a predetermined distance. A pair of transport rollers 17 for transporting sheets P are located at the upper end of the vertical conveyance path 15.

A guide member 27 is located at a position to which sheets are fed by the paired transport rollers 17. The above-mentioned register rollers 11, which are for registering the sheets, are located on the sheet discharge side of the guide member 27.

A large capacity sheet feeder 21, which is a paper sheet feeding apparatus, is arranged on the other side of the main body 1.

Figure 2:
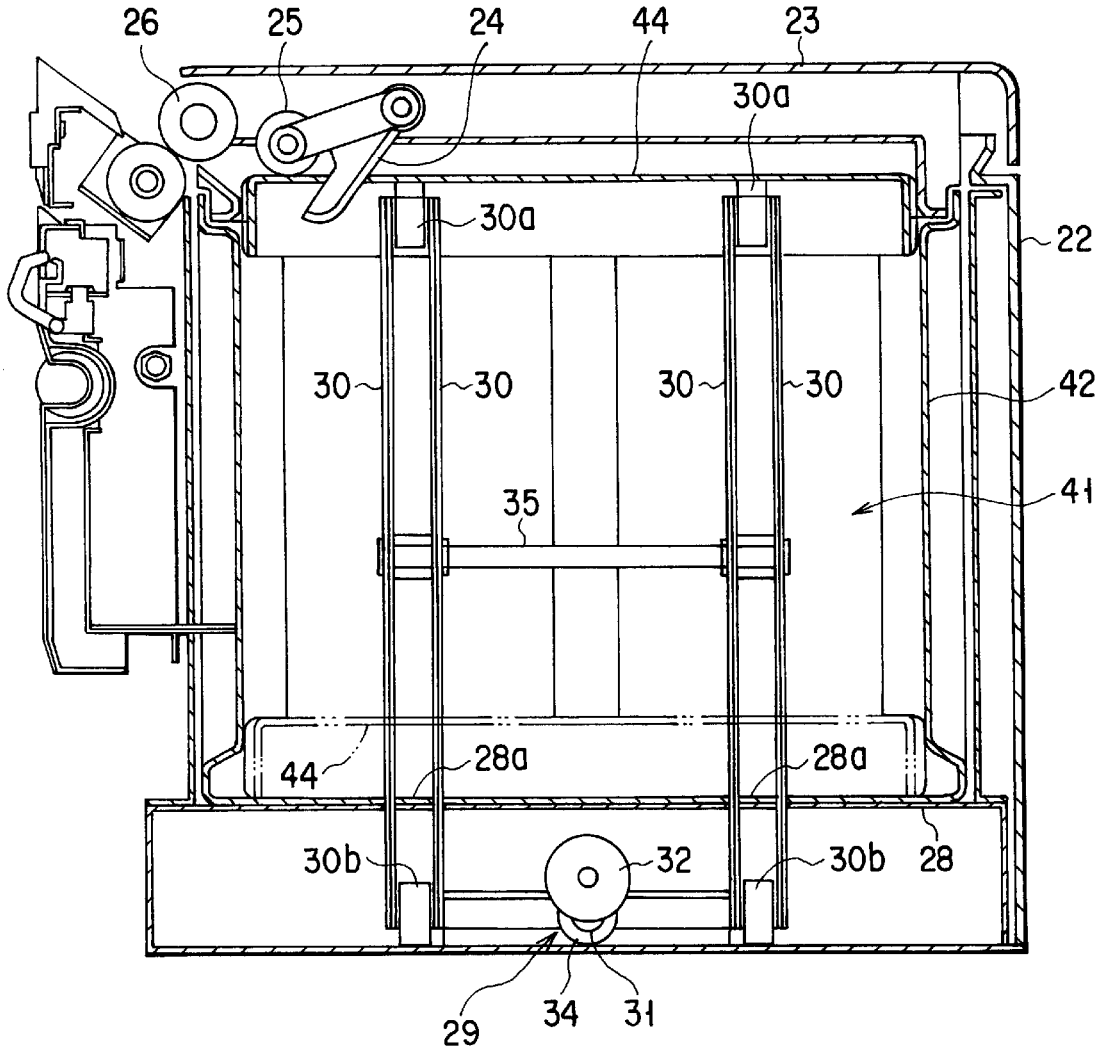
FIG. 2 is a longitudinal front view showing a sheet feeding apparatus.
Figure 3:
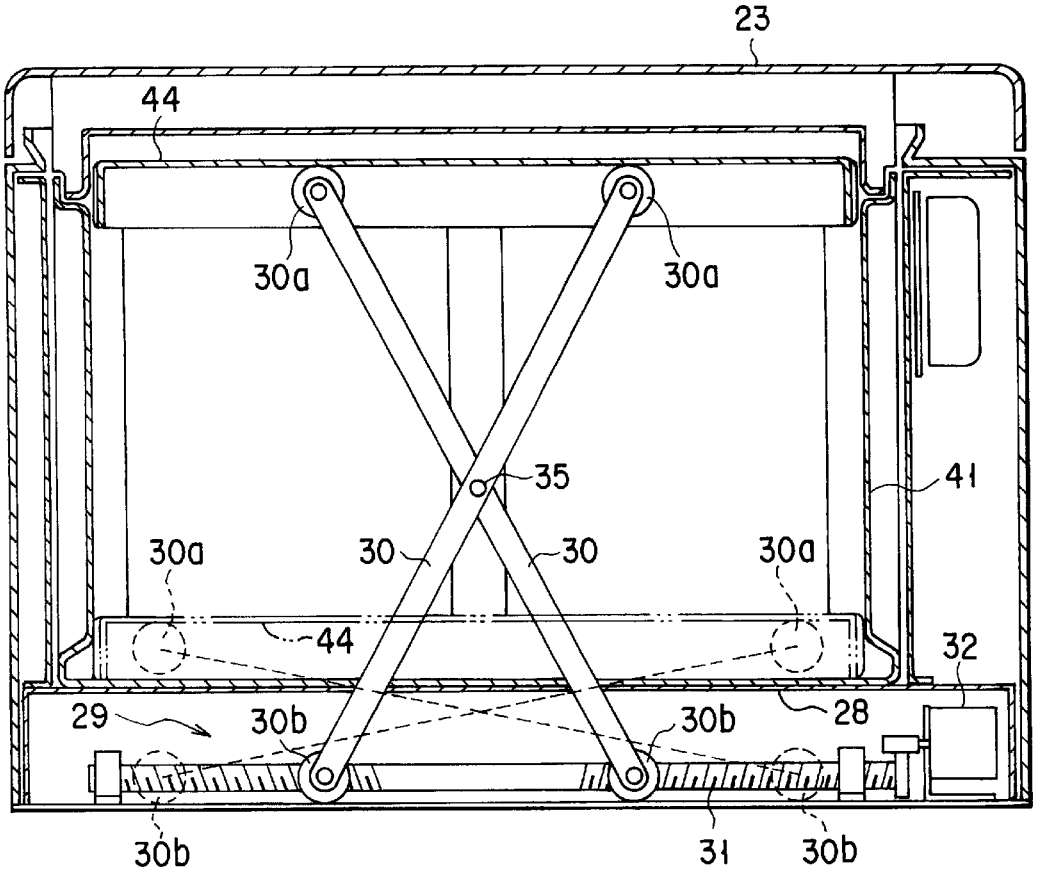
FIG. 3 is a longitudinal side view of the sheet feeding apparatus.

FIG. 2 is a longitudinal front view of the large capacity sheet feeder 21, and FIG. 3 is a longitudinal side view thereof. The large capacity sheet feeder 21 comprises a casing 22 serving as a main body. The casing 22 has an open top. The top opening 22*a* of the casing 22 can be closed by a lid member 23, which serves as an opening/closing member. A sensing arm 24 for sensing the level of the uppermost sheet, a pickup roller 25 for picking up the sheets P, and a pair of separation rollers 26 for separating the picked-up sheets from one another, are arranged on the inner surface of the lid member 23.

The inside bottom region of the casing 22 is partitioned by a bottom plate 28. In the space defined by this bottom plate 28, a raising mechanism 29, which serves as a raising means, is located. The raising mechanism 29 is made up of: raising arms 30, 30; driving shaft 31 for driving the raising arms 30, 30; and a driving motor 32 for rotating the driving shaft 31 in a reversible fashion. The raising arms 30, 30 are rotatably connected at their centers by means of a support shaft 35. Rollers 35*a* are rotatably attached to the upper ends of the raising arms 30, 30, and rollers 30*b*, to the lower ends of them. Elongated holes 28*a*, 28*a* are formed in the bottom plate 28, and the raising arms 30*a*, 30*a* are inserted into the elongated holes 28*a*, 28*a* in such a manner that the upper rollers 38*a*, 30*a* are projected above from the bottom plate 28. A cartridge 41, which will be detailed later, is arranged inside the casing.

Figure 4:
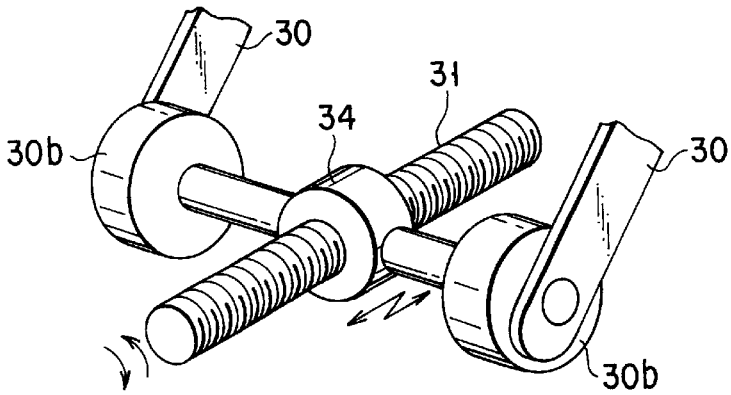
FIG. 4 is a perspective view showing part of a driving mechanism for driving a raising arm.

FIG. 4 is a perspective view showing how the raising arms 30, 30 and the driving shaft 31 are coupled. The rollers 30*a*, 30*a* attached to the lower ends of the raising arms 30, 30 are coupled together by means of a coupling bar 34, and the driving shaft 31 is threadably inserted into the central section of the coupling bar 34. When the driving shaft 31 is rotated in the normal or reverse direction, the rollers 30*b*, 30*b* at the lower ends of the raising arms 30, 30 move in the axial direction of the driving shaft 31. In relation to this movement, the raising arms 30, 30 rotate, with the support shaft 35 as an axis of rotation, and the upper rollers 30*a*, 30*a* are moved up or down thereby.

Figure 5:
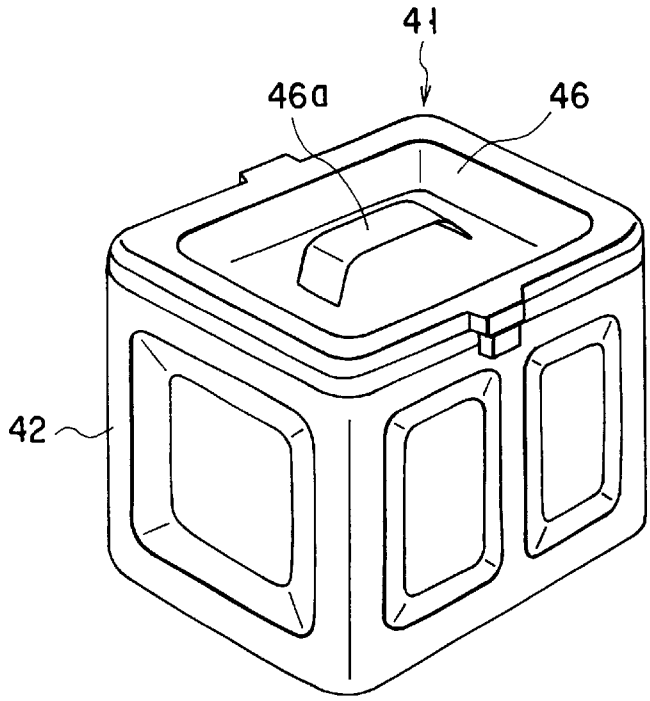
FIG. 5 is an outward-appearance perspective view showing a sheet cartridge.
Figure 6:
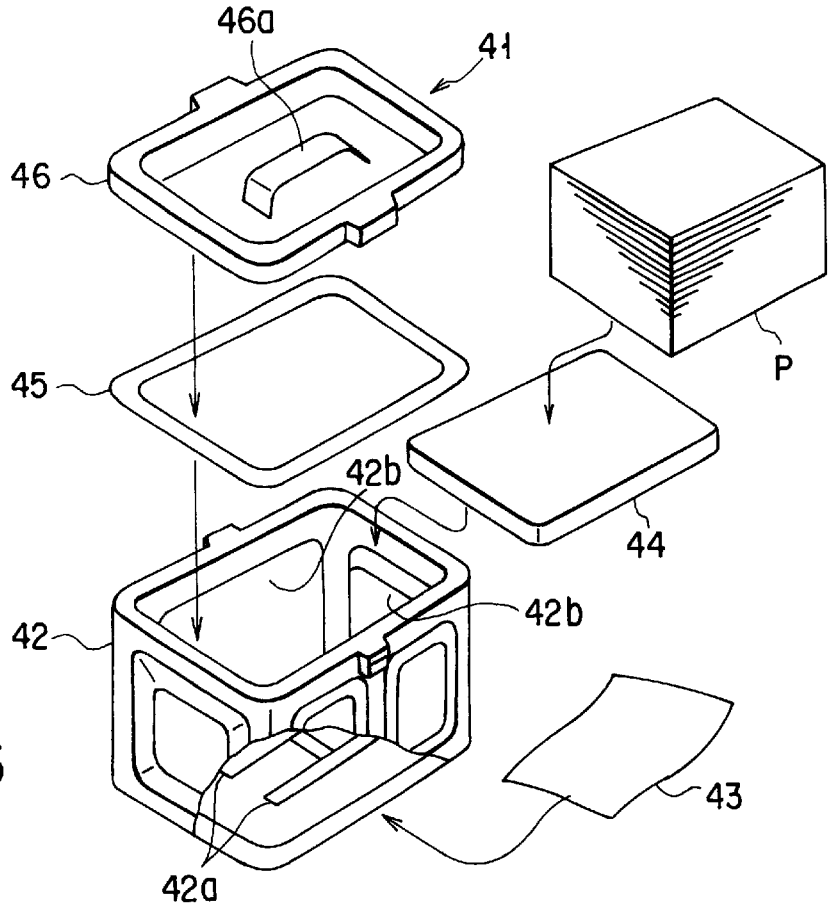
FIG. 6 is an exploded perspective view of the sheet cartridge.

FIG. 5 is a perspective view of the sheet cartridge 41, and FIG. 6 is an exploded perspective view thereof.

The sheet cartridge 41 includes a container 42 formed of synthetic resin. Elongated holes 42*a*, 42*a*, serving as insertion holes, are formed in the bottom of the container 42 in such a manner that the holes are parallel and spaced from each other by a predetermined distance. The elongated holes 42*a*, 42*a* are covered with a moisture-preventing seal film 43, which is detachably attached to the bottom surface of the container 42. A tray 44, serving as a holding member, is provided in the inside bottom region of the container 42. A large number of sheets P (e.g., 2,000 sheets), which are sheets of paper, for example, are stacked on the tray 44. In this stacked state, they are stored in the container. The inner walls of the container 42 have projected portions 42*b*, and these portions are projected inward. When sheets are stored in the container 42, their end and side portions are in contact with the projected portions 42*b* of the container 42, so that their corner portions do not touch the inner walls of the container 42.

A description will now be given as to how the cartridge 41 is loaded.

Figure 7:
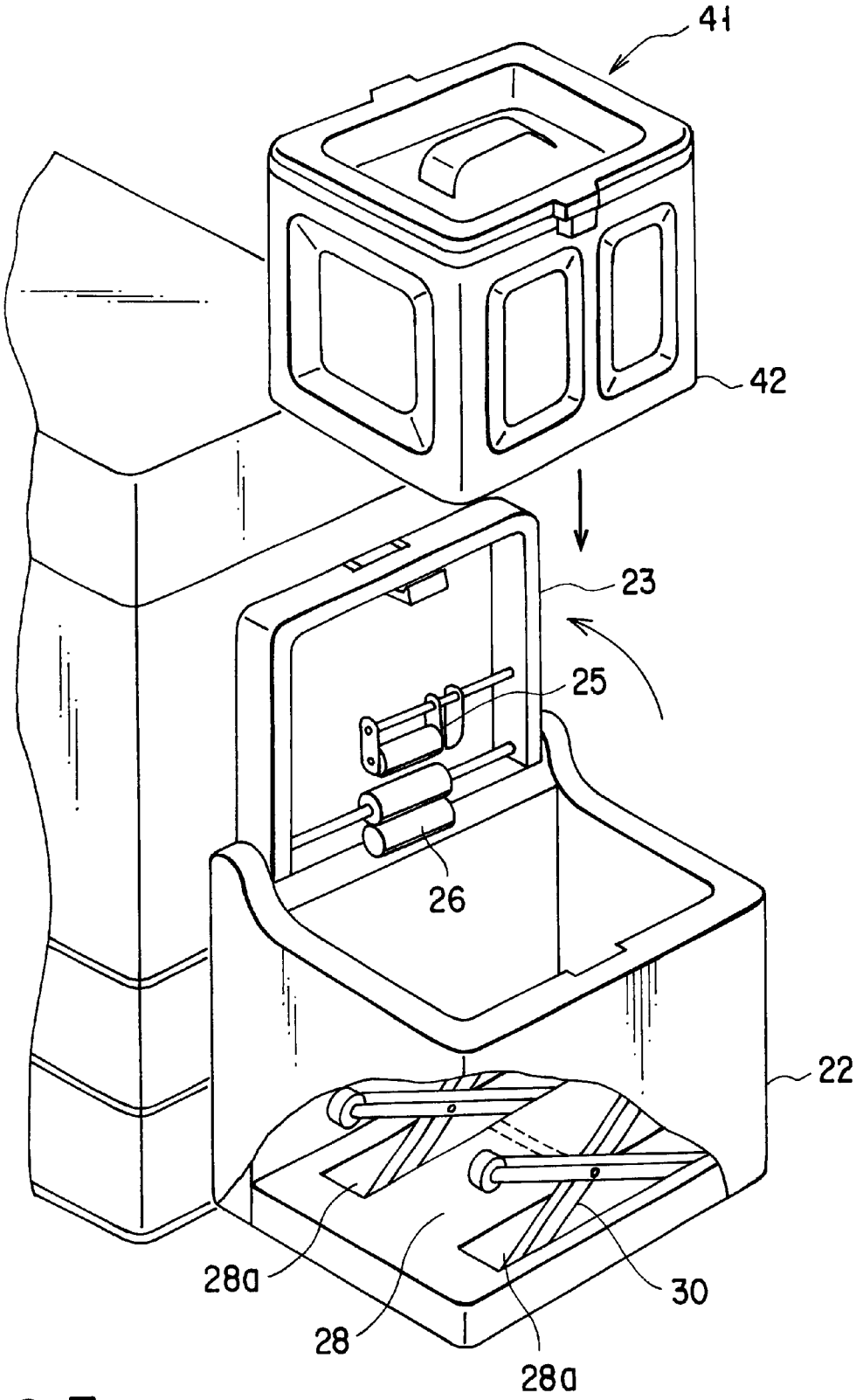
FIG. 7 is a perspective view showing how the sheet cartridge is loaded in the sheet feeding apparatus.
Figure 8:
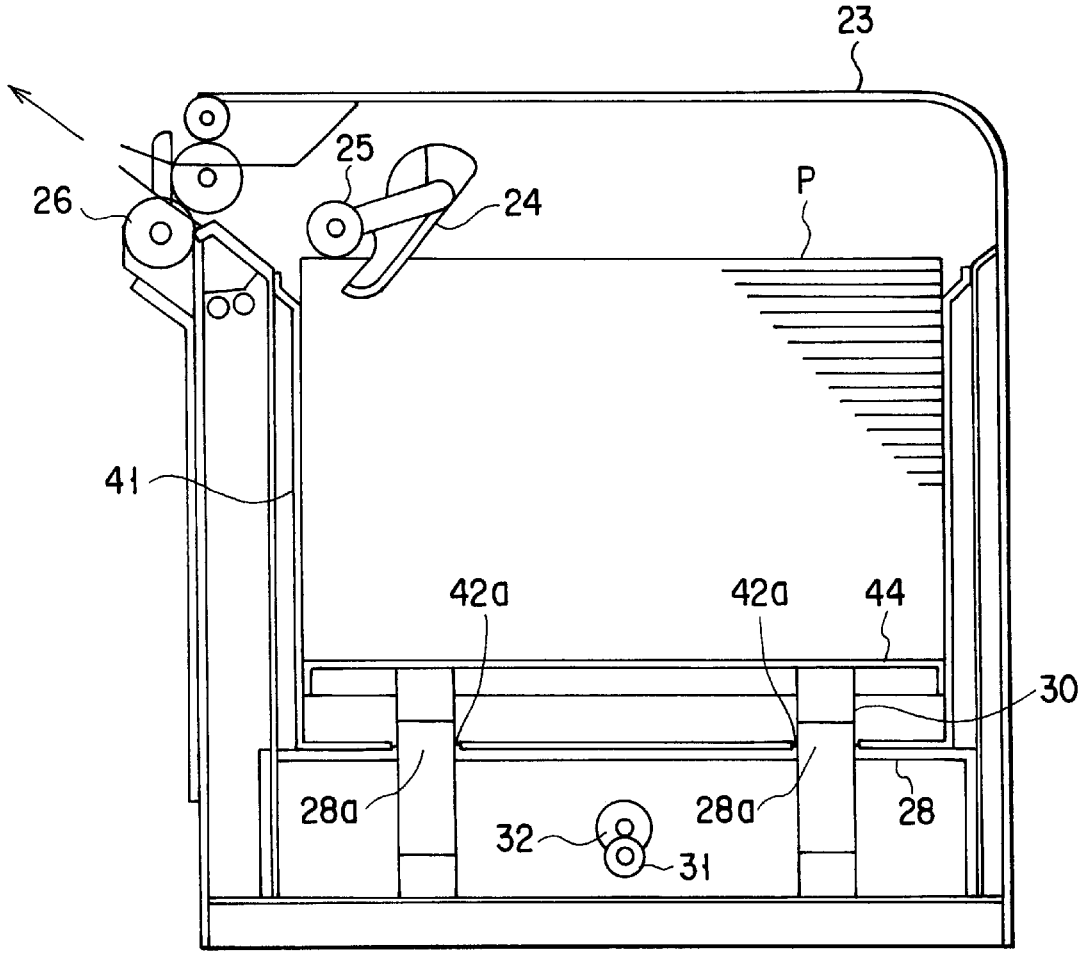
FIG. 8 is a longitudinal front view showing how the sheet cartridge is located in the sheet feeding apparatus.

Referring to FIG. 7, the lid member 23 of the large capacity sheet feeder 21 is opened, first of all. Subsequently, the seal film 43 is separated from the lower surface of the container 42 of the cartridge 41, and the cartridge 41 is inserted into the casing of the sheet feeder 21 from above, as indicated by the arrow. By this insertion, the upper rollers 30*a*, 30*a* of the raising arms 30, 30 are inserted into the respective elongated holes 42*a*, 42*a* of the container 42 and touch the lower surface of the tray 44. Then, the lid 46 of the container 42 is removed by holding a handle 46*a*, and the lid member 23 of the casing 22 is closed, as shown in FIG. 8.

After the cartridge 41 is loaded in this manner, the driving motor 32 is rotated in the normal direction. Thereby, the driving shaft 31 is rotated in the normal direction, and the lower rollers 30*b*, 30*b* of the raising arms 30, 30 move closer to each other. As a result, the raising arms 30, 30 move up, causing the upper rollers 30*a,* 30*a* to raise the tray 44. When the tray 44 has been raised and the upper surface of the stack of sheets P comes to the predetermined position, the stack of sheets P is pressed against the pickup roller 25 and sensed by the sensing arm 24. As a result of this sensing, the driving motor 32 is stopped. Then, the pickup roller 25 is rotated to take out the sheets P. The sheets P are fed to the separating roller 26, by which they are separated from one another and supplied one by one. After being registered by the register rollers 11, they are supplied to an image transfer section 20, where images are transferred onto the sheets. The sheets P bearing the images are supplied to the fixing unit 12, so as to fix the images on the sheets P. After the images are fixed, the sheets P are discharged onto the discharge tray 18 by means of the discharge rollers 17. When sheets P are take out by the pickup roller 25, the force with which the sheets P are pushed decreases. This decrease is sensed by the sensing arm 24. In response to the sensing of this state, the driving motor 32 is driven again, raising the sheets P. In this manner, the sheets P are pressed against the pickup roller 25 with uniform pressure at all times.

As described above, the container 42 of the cartridge 41, which can store a maximum replenishment number of sheets P, is inserted into the casing of the large storage sheet feeder 21, and the replenishment operation can be accomplished thereby. Unlike the prior art, therefore, the operation of replenishing the casing 22 with a limited number of sheets need not be repeated a number of times; the replenishing operation can be performed at one time. Since the wrapping paper need not be removed, the replenishing operation is easy.

Moreover, the container 42 of the cartridge 41 is inserted into the casing 22 of the sheet feeder 21 from above. Unlike the prior art sheet feeder that is replenished with horizontally supplied sheets, the subject sheet feeder does not have to use the space on one side thereof for the replenishment operation. Owing to this feature, the subject sheet feeder can be located as close as possible to a wall, thus allowing the installation space of the sheet feeder to be as small as possible.

The container 42 of the cartridge 41 can be used repeatedly. This eliminates the need for a wrapping material, which is eventually rubbish, and the sheets can be conveyed at low cost.

In the container 42, the sheets are stored in the sealed state.. Since they are not exposed to moisture, they can be kept in a desirable state for a long time.

The container 42 is formed of synthetic resin, they are strong against external shock, and damage to the sheets P can be reliably prevented.

The inner walls of the container 42 have inwardly projected portions 42*b*. When sheets are stored in the container 42, their corner portions do not touch the corner portions of the container 42. Hence, the corner portions of the sheets P are prevented from being deformed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet cartridge comprising:

a container having a holding member located in a bottom thereof and adapted to hold a maximum replenishment number of sheets in a stacked state; and an insertion hole which is formed by at least two slots in the bottom of the container and into which a member for raising the holding member is inserted.

2. A sheet cartridge according to claim 1, wherein the at least two slots are formed in parallel to each other.

3. A sheet cartridge comprising:

a container formed of synthetic resin and having an open top and a holding member, the holding member being located in a bottom of the container and holding a maximum replenishment number of sheets in a stacked state;

an opening/closing member for opening or closing the top of the container;

packing interposed between the opening/closing member and edges of the open top of the container;

an insertion hole which is formed in the bottom of the container and into which a member for raising the holding member is inserted; and a cover member which is removable and with which the insertion hole is covered.

4. A sheet cartridge according to claim 3, wherein said cover member is a detachable seal film.

5. A sheet cartridge according to claim 3, wherein inner walls of said container are projected inward by a predetermined amount, except for corner portions.

6. A sheet cartridge comprising:

a container having a holding member located in a bottom thereof and adapted to hold a maximum replenishment number of sheets in a stacked state; and an insertion hole which is formed in the bottom of the container and into which a member for raising the holding member is inserted, wherein inner walls of said container are projected by a predetermined amount, except for corner portions.

7. A sheet feeding apparatus comprising:

a main body having an open top;

a closing/opening member for closing or opening the main body;

a cartridge being insertable into the main body from above and storing sheets inside;

raising means, located at a bottom of the main body, for raising the sheets supplied by the replenishing means; and supply means, located on an inner surface of the closing/opening member, for taking out the raised sheets while being in contact therewith, said cartridge including:

a container having a holding member located in a bottom thereof, a maximum replenishment number of sheets being held on the holding member in a stacked state; and an insertion hole which is formed in the bottom of the container and into which the raising means is inserted to raise the holding member.

8. A sheet feeding apparatus according to claim 7, wherein said raising means raises the sheets when the sheets are fed thereto, thereby bringing the sheets into contact with the supply means.

9. A sheet feeding apparatus according to claim 7, wherein said raising means includes an arm that is vertically movable, said arm being inserted into the insertion hole to move up the holding member.

10. A sheet feeding apparatus according to claim 7, wherein said container is formed of synthetic resin.

11. A sheet feeding apparatus according to claim 7, wherein inner walls of said container are projected inward by a predetermined amount, except for corner portions.

* * * * *